United States Patent [19]

Gutridge et al.

[11] 4,227,465

[45] Oct. 14, 1980

[54] UPPER BERTH SUPPORT ARRANGEMENT

[75] Inventors: Jack E. Gutridge, Dyer; Walter J. Marulic, Gary, both of Ind.

[73] Assignee: Pullman Incorporated, Chicago, Ill.

[21] Appl. No.: 900,830

[22] Filed: Apr. 28, 1978

[51] Int. Cl.[3] ..... B61D 31/00

[52] U.S. Cl. ..... 105/321; 5/9 R

[58] Field of Search ..... 105/314–326; 5/9 R, 10 R, 118, 119; 114/192, 193

[56] References Cited

U.S. PATENT DOCUMENTS

| | | | |
|---|---|---|---|
| 1,555,038 | 9/1925 | Thweatt | 5/118 |
| 2,229,608 | 1/1941 | Ragsdale et al. | 105/315 |
| 2,531,687 | 11/1950 | Jones | 105/315 |
| 3,353,861 | 11/1967 | Froitzheim et al. | 5/9 R |

FOREIGN PATENT DOCUMENTS

| | | | |
|---|---|---|---|
| 560746 | 7/1958 | Canada | 105/325 |

*Primary Examiner*—Edward R. Kazenske

*Attorney, Agent, or Firm*—Richard J. Myers

[57] ABSTRACT

An upper berth is hingedly supported on the partition wall of a sleeping compartment. One end of the berth is provided with a vertical hanger member having an upper hook shape end which is adapted to engage a bracket mounted on the outer wall of the sleeping compartment. The hook and bracket arrangement provides a supple support for the berth in the use position and may easily be moved to a stowed position. The shelf arrangement supported by the bracket is positioned immediately adjacent the sleeping berth.

6 Claims, 5 Drawing Figures

FIG. 3
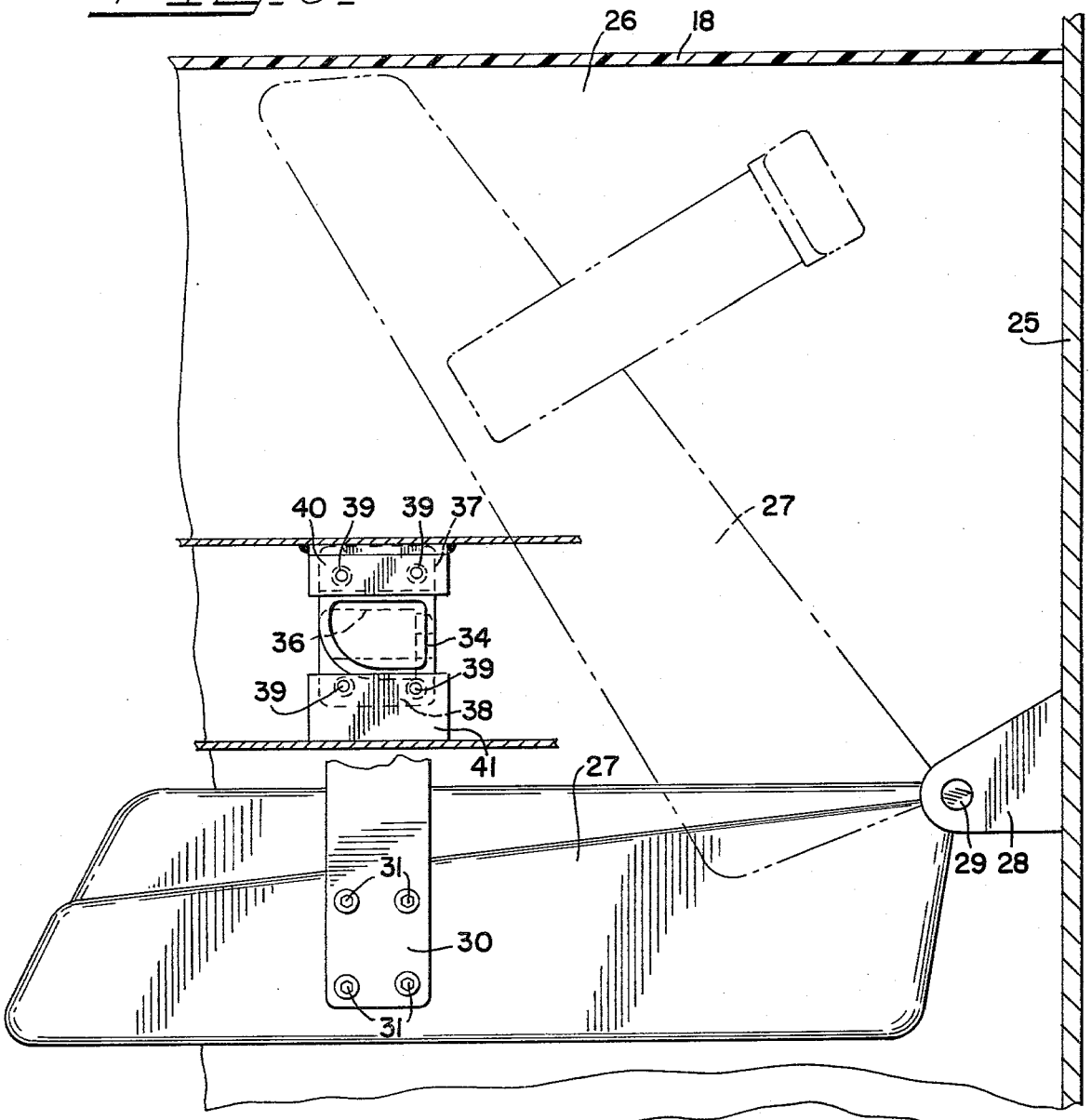
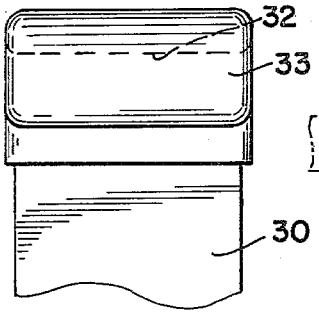
FIG. 4
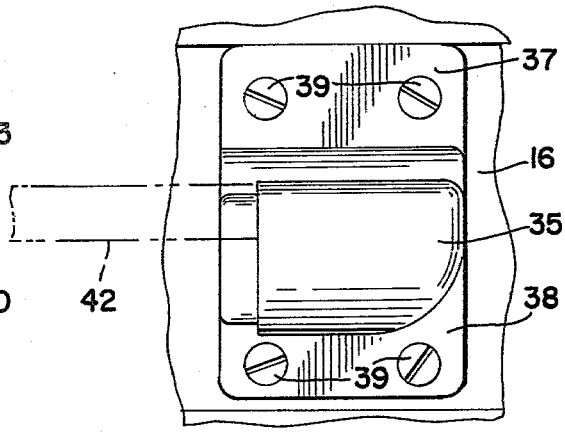
FIG. 5

UPPER BERTH SUPPORT ARRANGEMENT

BACKGROUND OF THE INVENTION

1. Field of the Invention

The field of invention relates to upper berth arrangements such as may be found in vehicles such as railway cars, buses, etc.

2. Description of the Prior Art

The prior art includes pertinent U.S. Pat. Nos. 248,673, Oct. 25, 1881; 1,262,894, Apr. 16, 1918; 2,553,297, May 15, 1951; 2,564,878, Aug. 21, 1951; and 2,632,183, Mar. 24, 1953. The present invention is an improvement over the aforementioned patents.

SUMMARY OF THE INVENTION

A vehicle sleeping compartment includes a partition wall and outer walls which support an upper berth. The berth is hingedly connected to the partition wall so as to be movable from a horizontal use to a diagonal upper non-use position. In the use position the berth is suspended from a bracket which is supported on one side of the compartment. The bracket comprises a tubular support member which has at its end an upwardly turned flange. One end of the upper berth is provided with a vertically extending hanger which projects upwardly with respect to the berth. The hanger includes at its upper end a hook portion which is covered by a flexible or plastic material and which is engaged over the vertical flange of the bracket so as to suspend the berth from said bracket. Besides the hinged connection of the berth to the partition wall the bracket provides the sole support for the berth and maintains the same against lateral and vertical instability. The bracket also provides one end support for a horizontal shelf which is positioned between the berth and the side wall of the compartment and which is readily available to the occupant when the berth is utilized in the sleeping or use positions.

BRIEF DESCRIPTION OF THE DRAWINGS

FIG. 1 is a cross-sectional view through a portion of a sleeping compartment in a vehicle such as a railway car or the like;

FIG. 3 is a cross-sectional view taken along the line 3—3 of FIG. 1;

FIG. 4 is a side elevational view of the upper end of a hanger and hook member; and FIG. 5 is a front elevational view of a support bracket mounted on the side wall of the car including a vertical supporting flange.

DESCRIPTION OF THE PREFERRED EMBODIMENT

Figure 1:
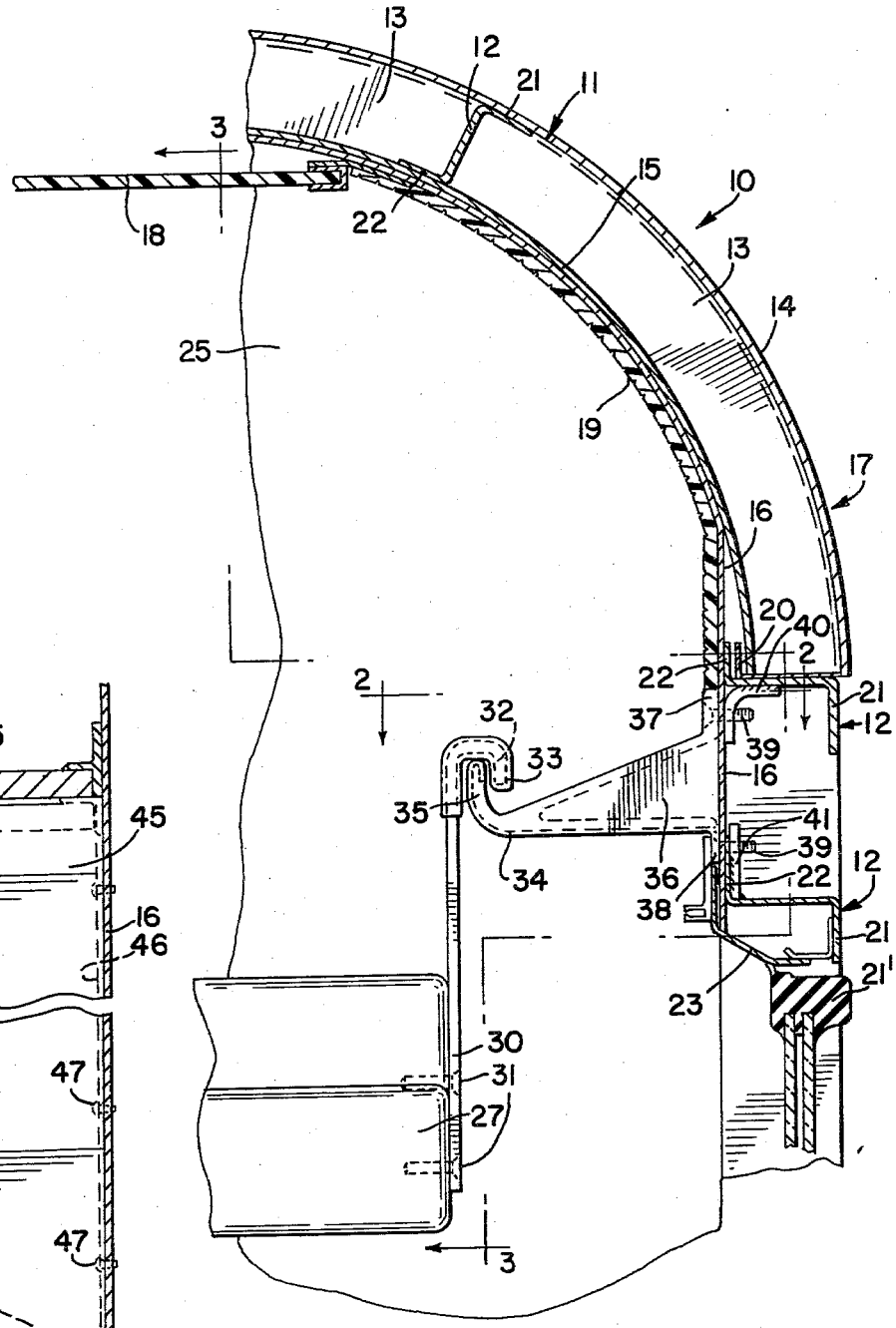

In FIG. 1 a portion of a sleeping compartment is disclosed with a berth arrangement in the use position. The compartment is designated by the reference character 10 and includes a car body 11 which consists of a plurality of longitudinally extending stringers 12 to which are connected horizontal arch support members 13. The body 11 includes outer sheathing or skin structure 14 suitably supported on the stringers 12 and arch support members 13. The arch support members include inner longitudinally disposed flanges 15. These in turn support inner side sheathing 16 extending partially downwardly on the outer wall 17. A horizontal ceiling panel 18 is suitably connected to the arch support structure 13, etc. An inner decorative panel 19 is adjacent the upper end of the ceiling 18 and is suitably connected to the inner side sheathing 16. The stringer 12 supported between the upper and lower stringers supports an angle 20 seated upon the stringer web. Each of the stringers 12 also includes flanges 21 and 22 turned in opposite directions to provide a C-shaped formation. The lowermost stringer 12 with the lower portion of the wall 16 and a shaped angle member 23 provide a boxlike formation which supports the upper end of a window structure 21'.

The compartment 10 further comprises a partition wall 25 as shown in FIG. 1 and a divider wall 26 perpendicular to the wall 25. A conventional type of berth or bed structure 27 is supported by means of hinge brackets 28 on the partition wall 25. Hinge pins 29 suitably hingedly connect the berth 27 to the brackets 28. As shown, one end of the berth 27 immediately adjacent the outer wall is provided with a vertically extending hanger strap 30 which projects upwardly above the berth and is provided with a hook member 32. The hook member 32 is integral with the strap 30 and the upper hook portion is covered by means of a plastic covering conforming to the shape of the hook. Such a covering may be a rubberlike material which is readily applied during manufacture. A bracket generally designated at 34 is secured to the side wall structure of the compartment. The bracket 34 includes an upwardly or upturned flange 35 which is adapted to be engaged by the hook-shaped member 32 for supporting and suspending the berth as indicated. The bracket 34 includes a hollow body 36 provided with upper and lower flanges 37 and 38 which are secured through the inner sheathing 16 by means of screws 39 which extend into and through brackets 40 and 41 suitably welded to the adjacent structures as indicated.

Figure 2:
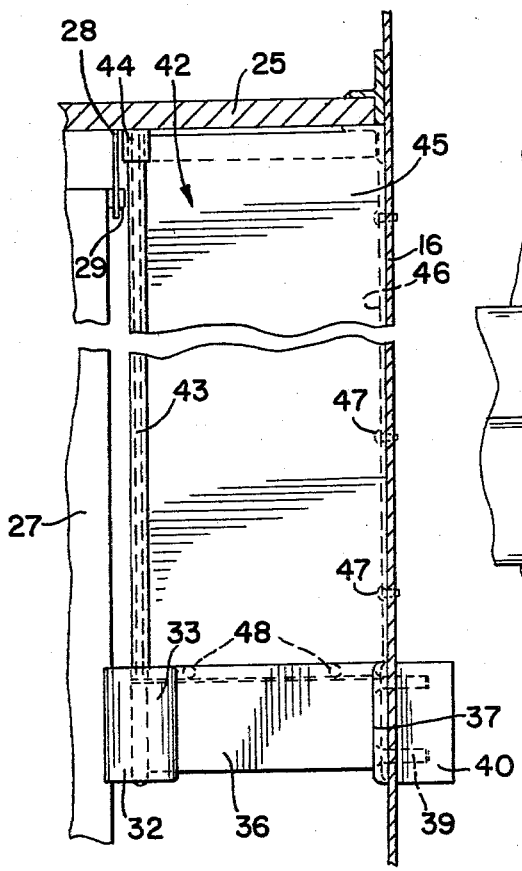
FIG. 2 is a cross-sectional view taken substantially along the line 2—2 of FIG. 1.

As best shown in FIG. 2 the shelf or traylike support 42 is positioned between the berth 27 and the side wall sheathing 16. The shelf includes a flat upright flange 43 suitably supported at one end in a socket 44 fastened to the partition wall 25. The flange 43 is in alignment with the upturned flange 35 of the bracket 34. As best shown in FIG. 2 the shelf has a downturned outer flange 46 which is connected by means of fasteners 47 to the inner sheathing 16. The shelf comprises a traylike bottom 45 which may support various items of the user during his retirement.

It is readily apparent that the berth is supported at one end by the hinge and the only other necessary support required is the simple arrangement disclosed which does not require any extensive mechanisms or structural modifications.

What is claimed is:

1. In a railway sleeping car compartment having a side wall, a ceiling wall and a transversely extending partition wall, the improvement comprising:

an upper berth, hinge means hingedly connecting said berth to said partition wall for hinging movement between a horizontal use position and an upper diagonal non-use position adjacent said ceiling wall, said hinge means being fixedly attached to said partition wall and fixed against vertical movement, said hinge means being attached to said berth along a rear longitudinal edge portion thereof adjacent said partition wall for allowing pivoting of the berth about an immovable pivot point substantially at the rear longitudinal edge portion of said berth adjacent said partition wall, supporting means for a free end of said berth including a bracket connected to said sidewall and projecting laterally outwardly with respect thereto, an outer vertically extending flange on said bracket, a rigid hook fixedly connected at the free end of said berth, said hook being non-pivotal and immobile relative to said berth, said hook in the use position of said berth parallel to said partition wall being substantially/and engaging said flange to support said berth and to provide lateral stability therefor; and a supporting shelf disposed between said berth and said sidewall when said berth is in said horizontal use position, said shelf having one end supported on said bracket and another end supported on said partition wall.

2. The invention in accordance with claim 1, said hook having a covering of plastic material.

3. The invention in accordance with claim 1, said flange being positioned in turned up relation relative to said bracket.

4. The invention in accordance with claim 1, said shelf extending longitudinally of the car.

5. The invention in accordance with claim 4, said shelf having an upturned flange in longitudinal alignment with said bracket flange.

6. In a railway sleeping car compartment having a side wall, a ceiling wall and a transversely extending partition wall, the improvement comprising:

an upper berth hinge means hingedly connecting said berth to said partition wall for hinging movement between a horizontal use position and an upper diagonal non-use position, adjacent said ceiling wall, said hinge means being fixedly attached against vertical movement relative to the partition wall and said hinge means being attached to a rear longitudinal edge portion of the berth adjacent said partition wall for allowing pivoting the berth about an immovable pivot point substantially at the rear longitudinal edge portion of the berth adjacent said partition wall, supporting means for a free end of said berth including a bracket connected to said sidewall and projecting laterally outwardly with respect thereto, an outer vertically extending flange on said bracket, a hanger strap being fixedly attached to the free end of the berth and being immobile with respect thereto, said strap being substantially parallel to said partition wall in said use position and comprising a rigid immovable non-pivotal upright member having at its top a hook, said hook in the use position of said berth engaging said flange to support said berth and to provide lateral stability therefor; and said hook coupling with said flange when said berth is pivotted about said hinge means and falls from an upper stored position to a horizontal in use position, said berth being gravitationally held in a horizontal position and stability.

* * * * *